US012157593B2

(12) United States Patent
Hamel

(10) Patent No.: US 12,157,593 B2
(45) Date of Patent: Dec. 3, 2024

(54) METHOD FOR OPERATING A BAGGING MACHINE

(71) Applicant: ROVEMA GMBH, Fernwald (DE)

(72) Inventor: Ingo Hamel, Fernwald (DE)

(73) Assignee: ROVEMA GMBH, Fernwald (DE)

( * ) Notice: Subject to any disclaimer, the term of this patent is extended or adjusted under 35 U.S.C. 154(b) by 1 day.

(21) Appl. No.: 18/267,707

(22) PCT Filed: Nov. 24, 2021

(86) PCT No.: PCT/EP2021/082740
§ 371 (c)(1),
(2) Date: Jun. 15, 2023

(87) PCT Pub. No.: WO2022/128371
PCT Pub. Date: Jun. 23, 2022

(65) Prior Publication Data

US 2024/0034501 A1 Feb. 1, 2024

(30) Foreign Application Priority Data

Dec. 18, 2020 (DE) ..... 10 2020 134 190.3

(51) Int. Cl.
*B65B 57/14* (2006.01)
*B65B 9/06* (2012.01)
(Continued)

(52) U.S. Cl.
CPC ..... *B65B 57/145* (2013.01); *B65B 9/06* (2013.01); *B65B 9/10* (2013.01); *B65B 43/08* (2013.01); *B65B 51/26* (2013.01); *B65B 61/06* (2013.01)

(58) Field of Classification Search
CPC ..... B65B 57/145; B65B 57/14; B65B 9/06; B65B 9/10
See application file for complete search history.

(56) References Cited

U.S. PATENT DOCUMENTS 3,488,914 A 1/1970 Csernak
3,684,254 A * 8/1972 Henry ..... B65B 1/22 53/551
(Continued)

FOREIGN PATENT DOCUMENTS

DE 2732917 A1 4/1978
DE 10131902 A1 1/2003
(Continued)

*Primary Examiner* — Gloria R Weeks
(74) *Attorney, Agent, or Firm* — Dickinson Wright PLLC; Andrew D. Dorisio

(57) ABSTRACT

The invention relates to a method for operating a bagging machine (01) having at least one vibration sensor (15, 18, 19) and a vibration evaluation device (16), wherein airborne and/or structure-borne signals can be measured with the vibration sensor (15, 18, 19), and wherein the measurement signals of the vibration sensor (15, 18, 19) can be evaluated with the vibration evaluation device (16), wherein a) airborne and/or structure-borne signals produced by the filling material during operation of the bagging machine (01) are measured with the vibration sensor (15, 18, 19) on the format tube (06), b) the measurement signals of the vibration sensor (15, 18, 19) are evaluated by the vibration evaluation device (16), c) a function signal is output depending on the evaluation results.

6 Claims, 1 Drawing Sheet

(51) Int. Cl.

| | |
|---|---|
| ***B65B 9/10*** | (2006.01) |
| ***B65B 43/08*** | (2006.01) |
| ***B65B 51/26*** | (2006.01) |
| ***B65B 61/06*** | (2006.01) |

(56) References Cited

U.S. PATENT DOCUMENTS

| | | | | |
|---|---|---|---|---|
| 5,540,035 | A * | 7/1996 | Plahm | B29C 66/83421 53/550 |
| 5,819,511 | A * | 10/1998 | Schlosser | B65B 43/16 141/114 |
| 6,119,438 | A * | 9/2000 | Bacon | B65B 9/2028 53/493 |
| 6,378,270 | B1 * | 4/2002 | Araki | B65D 90/54 53/284.7 |
| 7,305,933 | B2 * | 12/2007 | Kitagawa | A23P 20/17 53/111 R |
| 8,707,661 | B2 * | 4/2014 | Kinoshita | B29C 66/81429 53/503 |
| 8,938,938 | B2 * | 1/2015 | Konno | B29C 66/1122 53/554 |
| 8,943,786 | B2 * | 2/2015 | Konno | B29C 65/7451 53/511 |
| 9,003,749 | B2 | 4/2015 | Kamigaito | |
| 9,540,123 | B2 * | 1/2017 | Vollenkemper | B65B 1/32 |
| 2003/0000179 | A1 * | 1/2003 | Nakagawa | B65B 57/14 53/493 |
| 2004/0144177 | A1 | 7/2004 | Flock et al. | |
| 2014/0352266 | A1 | 12/2014 | Seidel et al. | |
| 2020/0317382 | A1 * | 10/2020 | Savoie-Lavigueur | B65B 1/30 |

FOREIGN PATENT DOCUMENTS

| | | | |
|---|---|---|---|
| DE | 102010028697 | B3 | 11/2011 |
| DE | 102016205675 | A1 | 10/2017 |
| DE | 102016213434 | A1 | 11/2017 |
| DE | 102016215522 | A1 | 2/2018 |
| GB | 2450223 | A | 12/2008 |
| JP | H08217028 | A | 8/1996 |
| JP | 2020006982 | A | 1/2020 |

* cited by examiner

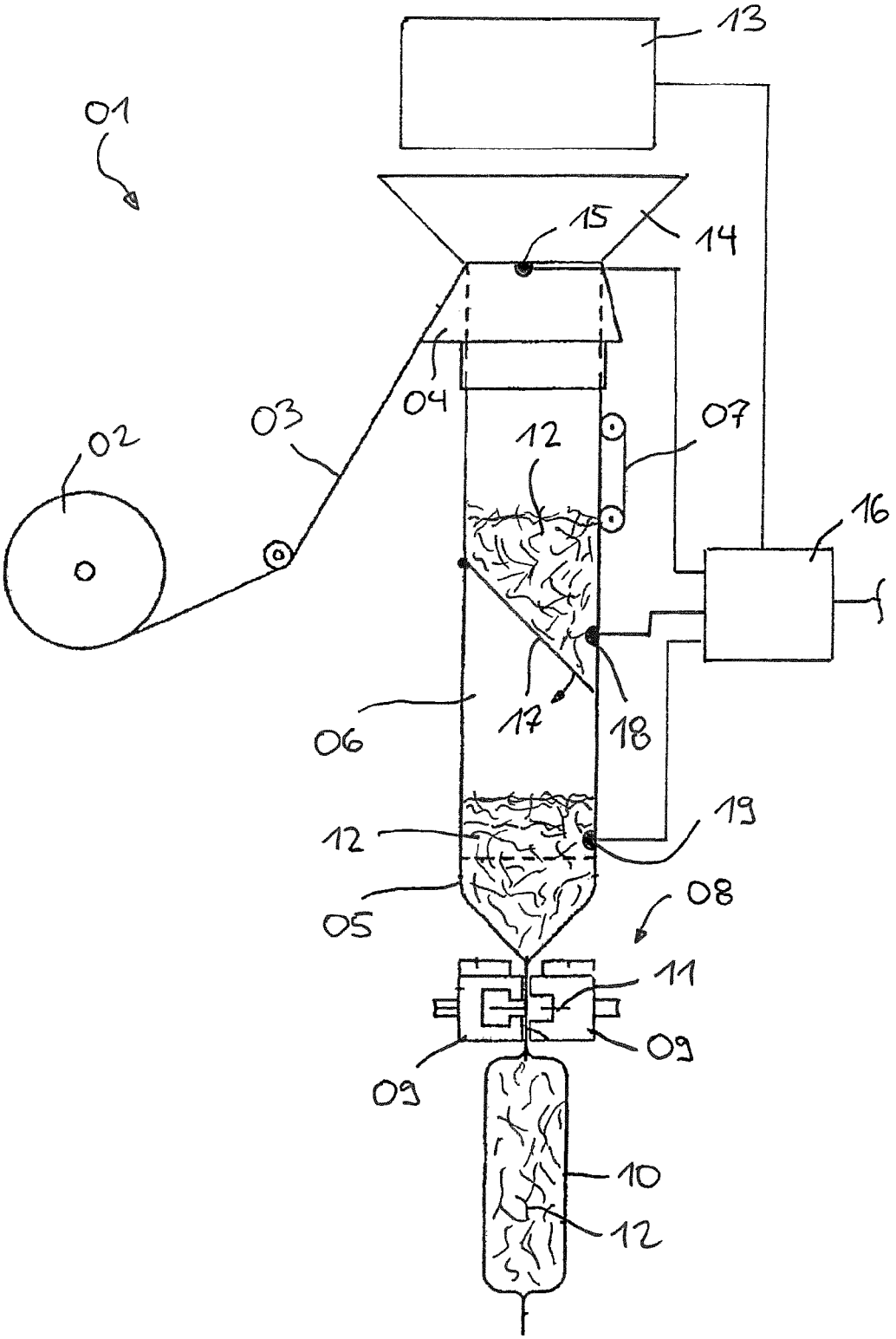
13
01
15
14
04
03
02
12
07
16
17
18
06
12
19
05
08
11
09
09
10
12

METHOD FOR OPERATING A BAGGING MACHINE

TECHNICAL FIELD

The invention relates to a method for operating a bagging machine according to the preamble to claim 1.

BACKGROUND

Known from DE 10 2010 028 697 A1 is a bagging machine that is suitable for packaging pourable goods. Provided above the actual bagging machine is a dosing device with screw dosing, with which the pourable goods can be supplied in a dosed form for the individual packages. A vibration sensor is arranged on the dosing device, so as to monitor the proper operation of the dosing device by suitably evaluating the sound signals on the funnel of the dosing device. As soon as a foreign part, in particular a metal part, falls into the dosing device, it triggers corresponding noises and sound signals, which can be acquired with the vibration sensor and detected via suitable signal evaluation. In other words, this means that the vibration sensor enables damage monitoring, so as to prevent the supply of foreign parts, in particular metal parts.

Proceeding from this prior art, the object of the present invention is to propose a method for operating a bagging machine with a vibration sensor and suitable vibration evaluation device, with which the actual packaging process can be improved.

SUMMARY

Advantageous embodiments of the invention are the subject of the subclaims.

So-called format tubes are used in known bagging machines to feed the filling material into the individual bags before the latter are sealed by cross welding the tubular film. The film sleeve formed out of the film web with the help of a forming shoulder is guided on the outside of the format tube. The filling material is fed into the interior of the format tube from above, and falls into the still open bags before the latter are sealed by cross welding the film web. As the clock frequencies steadily rise during the production of the bags, so too does the clock with which the filling material must be fed into the bag through the format tube. The steadily rising clock speeds here yield an increasing number of interference sources that can disrupt the operation of the bagging machine. For example, if the filling material becomes obstructed in the format tube, the bags are no longer filled with the desired quantity of filling material, and thus constitute rejected goods. Proceeding from this prior art, it is thus the object of the present invention to propose a method for operating a bagging machine with which the disadvantages to prior art described above can be avoided.

Advantageous embodiments are the subject of the subclaims.

The core idea of the method according to the invention is that the airborne and/or structure-borne sound signals generated by the filling material are measured with a vibration sensor on the format tube during the operation of the bagging machine. This is because the structure-borne sound signals generated by the filling material in the format tube provide significant information about the procedural status of the packaging process, and in particular can identify known interference sources early on. The measurement signals measured with the vibration sensor on the format tube are subsequently evaluated with a vibration evaluation device, and a function signal is output depending on the evaluation result. For example, this function signal can be a stop signal, with which the bagging machine is stopped, e.g., given a blockage of filling material in the format tube. In particular, the process of measuring the airborne and/or structure-borne sound signals on the format tube can be monitored and controlled to ensure that the passage or impact of filling material in the format tube or at the lower end of the format tube generates significant sound patterns, which significantly characterize the packaging process. This results in possible options for detecting interference and self-optimizing the bagging machine.

The sound signals can be acquired with the vibration sensor at basically any location of the format tube. A first preferred method variant provides that the vibration sensor be arranged at the upper end of the format tube under a preformatting container or funnel. In this way, the vibration sensor can be used to measure the sound signal pattern generated by the filling material in the preformatting container or funnel, and thereby monitor it. Alternatively or additionally to the first method variant, the vibration sensor can also be arranged between the upper end and the lower end of the format tube. In this way, the vibration sensor can be used to measure and evaluate the sound signal pattern generated by the filling material as it passes through the format tube as the filling material contacts the interior of the format tube. This type of measurement is particularly suitable for detecting and reacting to blockages in the format tube. Additionally or alternatively to the first two method variants, the vibration sensor at the lower end of the format tube can be arranged above a cross sealing unit. The corresponding vibration sensor can then be used to measure and evaluate the sound signal pattern generated by the filling material as it hits the sealing jaws. In particular, this makes it possible to detect when no filling material or much too little filling material was supplied, thereby only generating a weak sound signal pattern during impact on the sealing jaws. The method according to the invention offers special advantages even when preformatting by means of a preformatting flap takes place in the corresponding packaging process. In these packaging processes, the filling material is first measured with a suitable measuring device, for example a scale, and then prepared for the continued packaging process by being dropped on an initially still closed preformatting flap. In the next work cycle, the preformatting flap is then opened, and the measured quantity of filling material is downwardly filled into the opened bag. By measuring the sound signal patterns in the area of the preformatting flap, the sound signal patterns generated as the filling material impacts the preformatting flap can be detected and monitored. Basically any type of function signal can be output depending on the evaluation result during the evaluation of measurement signals of the vibration sensor. As already described above, for example, the entire bagging machine can be stopped as soon as the evaluation of sound signals has detected an interference in the bagging machine. A preferred method variant provides that a function signal be output depending on the evaluation result, with which the drop pulse of a scale used to weigh the filling material above the preformatting flap is synchronized with the opening pulse of the preformatting flap. The synchronization between the preformatting flap and drop pulse of the scale can be used to eliminate undesired interference events produced by signal fading between the drop pulse and the scale and the preformatting flap.

BRIEF DESCRIPTION OF THE DRAWING

The method according to the invention will be exemplarily described below based on the drawing.

Shown on:

FIG. 1 is a schematically illustrated bagging machine while implementing the method according to the invention in cross section.

DETAILED DESCRIPTION

FIG. 1 shows a schematically illustrated bagging machine 01, wherein FIG. 1 only shows the parts of the bagging machine 01 that are necessary for understanding the invention. A film web 03 is unwound from a supply roll 02, and then formed into a film sleeve 05 on a forming shoulder 04. The film sleeve 05 slides downwardly on the exterior side of a format tube 06, driven by a film outlet 07, wherein the film sleeve 05 is longitudinally sealed parallel to its transport direction by means of a longitudinal sealing device not shown on FIG. 1.

Located below the format tube 06 is a cross sealing device 08 with two cross jaws 09 for generating cross seams, with which the film sleeve 05 is cross welded into individual bags 10. A separating device 11 is integrated into the cross jaws 09, with which the individual bags 10 can be separated from each other after cross welding.

The filling material 12 for filling the bags 10 is measured with a measuring device, for example a scale 13, in such a way as to reach the respective fill quantity provided for a bag 10. An opening pulse in the scale 13 causes the measured filling material to drop into the funnel 14 lying thereunder. The filling material is merged to the diameter of the format tube 06 via the funnel 14. A first vibration sensor 15 is located at the upper end of the format tube 06 and below the funnel 14, and can be used to acquire the airborne and/or structure-borne signals as the filling material passes through the funnel 14. The corresponding measurement signals are relayed via a cable to a vibration evaluation device 16, so that the measurement signals are evaluated, and interference in the area of the funnel 14 can be detected. For example, suitably comparing the vibration signal patterns with prestored target patterns makes it possible to identify interference with the vibration evaluation device 16, and then to initiate a machine stop as a function thereof, for example.

After the filling material 12 is passed through the funnel 14, it continues to drop down through the format tube, and hits an initially still closed preformatting flap 17. The closed preformatting flap 17 initially holds back the filling material 12, until the bag lying thereunder is transported further, and sealed through cross sealing by means of the cross sealing device 08, so that the next bag can be filled. The airborne and structure-borne signals that arise as the filling material 12 hits the upper side of the preformatting flap 17 can be measured with a vibration sensor 18. The measurement signals of the vibration sensor 18 are likewise evaluated in the vibration evaluation device 16, and suitable function signals are output depending on the measuring result.

In particular the drop pulse of the scale 13 can here be synchronized with the movement control of the preformatting flap 17 by suitably evaluating the sound signals acquired by the vibration sensor 18.

As soon as the preformatting flap 17 is opened after the further transport of the bag lying thereunder, the filling material drops onto the still closed cross sealing jaws 09 of the cross sealing device 08. The airborne and/or structure-born sound signals that arise in this process can be acquired with a vibration sensor 19 and evaluated by means of the vibration evaluation device 16. In particular, this makes it possible to determine if no filling material has dropped down, wherein an undesired interference caused by blockage of the filling material 12 has come about in the format tube 06, for example.

The invention claimed is:

1. A method for operating a bagging machine (01) with a film web (03) that can be unwound from a supply roll (02), a forming shoulder (04) for forming the film web (03) into a film sleeve (05), a film outlet (07) that acts against the film sleeve (05) for further moving the film sleeve (05), a vertically aligned format tube (06) for receiving and filling the film sleeve (05) with a filling material (12), a longitudinal sealing device for welding the film sleeve (05) parallel to its transport direction by means of a cross seam, a cross sealing device (08) with cross jaws (09) that can be moved against each other and weld the film sleeve (05) transverse to the transport direction to generate cross seams, a separating device (11) for separating finished bags (10) from the film sleeve (05), and with at least one vibration sensor (15, 18, 19) as well as a vibration evaluation device (16), wherein the vibration sensor (15, 18, 19) can be used to measure airborne or structure-borne sound signals, and wherein the vibration evaluation device (16) can be used to evaluate the measurement signals of the vibration sensor (15, 18, 19), wherein a) during the operation of the bagging machine (01), airborne or structure-borne sound signals generated by the filling material are measured with the vibration sensor (15, 18, 19) on the format tube (06), b) the measurement signals of the vibration sensor (15, 18, 19) are evaluated by the vibration evaluation device (16), c) a function signal is output depending on the evaluation results.

2. The method according to claim 1, wherein the vibration sensor (15) is arranged at the upper end of the format tube (06) under a preformatting container or funnel (14), wherein the vibration sensor (15) is used to measure the airborne or structure-borne sound signals generated by the filling material in the preformatting container or funnel (14).

3. The method according to claim 1, wherein the vibration sensor (18) is arranged between the upper end and the lower end of the format tube (06), wherein the vibration sensor is used to measure the airborne or structure-borne sound signals generated by the filling material (06) as it passes through the format tube (06).

4. The method according to claim 1, wherein the vibration sensor (19) is arranged at the lower end of the format tube (06) above a cross sealing unit (08), wherein the vibration sensor (19) is used to measure the airborne or structure-borne sound signals generated by the filling material as it hits the cross sealing jaws (09).

5. The method according to claim 1, wherein the vibration sensor (18) is arranged in the area of a preformatting flap (17), wherein the vibration sensor (18) is used to measure the airborne or structure-borne sound signals generated by the filling material as it hits a preformatting flap (17).

6. The method according to claim 5, wherein a function signal is output depending on the evaluation results, with which the drop pulse of a scale (13) used to weigh the filling material (12) above the preformatting flap (17) is synchronized with the opening pulse of the preformatting flap (17).

* * * * *